United States Patent [19]

Hughes

[11] 4,178,839

[45] Dec. 18, 1979

[54] CARTON ERECTING APPARATUS

[75] Inventor: Charles C. Hughes, Ludlow, Ky.

[73] Assignee: R. A. Jones & Co. Inc., Covington, Ky.

[21] Appl. No.: 834,166

[22] Filed: Sep. 19, 1977

Related U.S. Application Data

[63] Continuation-in-part of Ser. No. 723,992, Sep. 16, 1976, Pat. No. 4,057,008.

[51] Int. Cl.[2] ..... B31B 5/00

[52] U.S. Cl. ..... 93/53 SD; 271/107

[58] Field of Search ..... 93/53 M, 53 R, 53 BF, 93/53 SD; 271/90, 99, 106, 107

[56] References Cited

U.S. PATENT DOCUMENTS

| | | | |
|---|---|---|---|
| 2,890,560 | 6/1959 | Nigrelli et al. | 93/53 R X |
| 3,104,598 | 9/1963 | Davie | 93/53 BF |
| 3,476,023 | 11/1969 | Fuller et al. | 93/53 R X |
| 3,476,024 | 11/1969 | Deering et al. | 93/53 R |
| 3,534,667 | 10/1970 | Krause | 93/53 BF |
| 3,888,164 | 6/1975 | Taddei | 93/53 SD X |
| 3,956,576 | 5/1976 | Vogel et al. | 93/53 SD |
| 4,011,799 | 3/1977 | Chidsey | 93/53 SD |
| 4,034,658 | 7/1977 | Sherman | 93/53 SD |

*Primary Examiner*—Leon Gilden

*Attorney, Agent, or Firm*—Wood, Herron & Evans

[57] ABSTRACT

Method and apparatus for erecting cartons wherein a flat folded carton blank is conveyed to the apparatus where it is momentarily stopped. Suction cups pull the underside of the blank downwardly against a breaker bar to bow the underside downwardly pulling the leading and trailing ends of the blank toward each other and thus bowing the upper carton side upwardly. With the carton thus partially opened, an overhead opening element rotates into engagement with a trailing side panel of the carton to swing it through an arc of about 90° until it is substantially vertical. An overbreak element thereafter engages the now vertical trailing side panel and swings it through another 90° to overbreak the carton. In this condition, the carton is conveyed out of the erecting apparatus and into transport lugs of the transport conveyor of a cartoner.

8 Claims, 6 Drawing Figures

CARTON ERECTING APPARATUS

This is a continuation-in-part of my co-pending application Ser. No. 723,992, filed Sept. 16, 1976 now U.S. Pat. No. 4,057,008.

This invention relates to a method and apparatus for erecting tubular cartons, and more particularly, the invention is an improvement in carton erecting of the type disclosed in U.S. Pat. No. 3,476,024.

In U.S. Pat. No. 3,476,024, a flat folded tubular carton blank is fed from a magazine in flat folded condition and conveyed to an erecting station. The carton blank has top and bottom panels interconnected by leading and trailing side panels, the leading panel facing upwardly and the trailing panel facing downwardly. The axis of the tubular carton is transverse to the direction of movement from the magazine through the erecting station to the transport conveyor. At the erecting station, which is ahead of a transport conveyor having spaced upwardly-directed lugs into which the cartons are to be fed, the carton blank is held stationary momentarily. A knife is projected transversely into each end of the carton where it partially opens the carton (about ¼"). Each knife has an edge which lies adjacent to the crease interconnecting the trailing side panel with the bottom panel. A cam-operated finger is caused to move upwardly into engagement with the trailing side panel to start to swing the trailing side panel toward a vertical position. When the trailing side panel begins to swing upwardly, a trailing pair of lugs in the transport conveyor swings up behind the carton blank and completes the raising of the trailing side panel to a vertical orientation. As the trailing side panel swings to vertical, it effects the erection of the carton to a rectangular form.

The mechanism of U.S. Pat. No. 3,476,024 performs the erecting operation satisfactorily but has two disadvantages which the present invention overcomes. First, the erecting apparatus requires a complex cam-operated erecting finger and further requires a complex mechanism for the knives which must be projected into the carton and then out of the carton before the transport lugs carry the carton away from the erecting station. The second disadvantage is related to the first in that the requirement of projecting knives into and out of the carton necessarily imposes a limiting factor on the number of cartons per minute which can be cycled through the machine.

An objective of the present invention has been to provide an improved carton erecting apparatus which is considerably less complex than those employed heretofore. Another objective of the invention has been to provide means preventing elbowing during the opening of a carton. "Elbowing" refers to the tendency of the carton blank to stay closed when an attempt to open is made by swinging a side wall upwardly with respect to a front or back wall to begin the opening of a carton. With the carton remaining closed all walls stay together and the blank bows in an L-shape.

The erecting operation is significantly improved by substituting for the reciprocating knives the combination of at least one suction cup and a supporting surface on each side of the suction cup to effect the partial opening of the carton. More specifically, underlying the carton blank at the location where the carton blank is momentarily stopped for the erecting operation, a transverse breaker bar is engageable by the underside of the carton. A plurality of transversely spaced suction cups, which are stationary, are disposed alongside the breaker bar. At the opposite side of the cups from the breaker bar is another supporting surface, which could be another breaker bar, or as shown in the first embodiment, a conveyor belt passing over a roll. The two supporting surfaces are spaced well inboard of the leading and trailing edges of the blank. When vacuum is applied to the suction cups, the lips of the suction cups move downwardly with respect to the supporting surface. The lower side of the carton is thus bowed slightly downwardly between the breaker bar and the opposed supporting surface. As the lower side of the carton, consisting of the bottom panel and trailing side panel, is bowed downwardly, the leading and trailing edges of the blank are drawn slightly toward each other thereby causing the upper portion of the carton, consisting of the top panel and leading side panel, to move upwardly away from the bottom panel and trailing side panel, thus partially opening the carton. Thereafter, when the carton is engaged by other elements to open it completely, the tendency of the carton to elbow is eliminated because of the partial opening effected by the initial bowing of one surface.

The concept of engaging a blank between its edges by two supporting surfaces and a movable suction cup therebetween is usable in a variety of blank opening environments as will appear below.

The several objectives and features of the invention will become more readily apparent from the following description taken in conjunction with the drawings in which.

Figure 1:
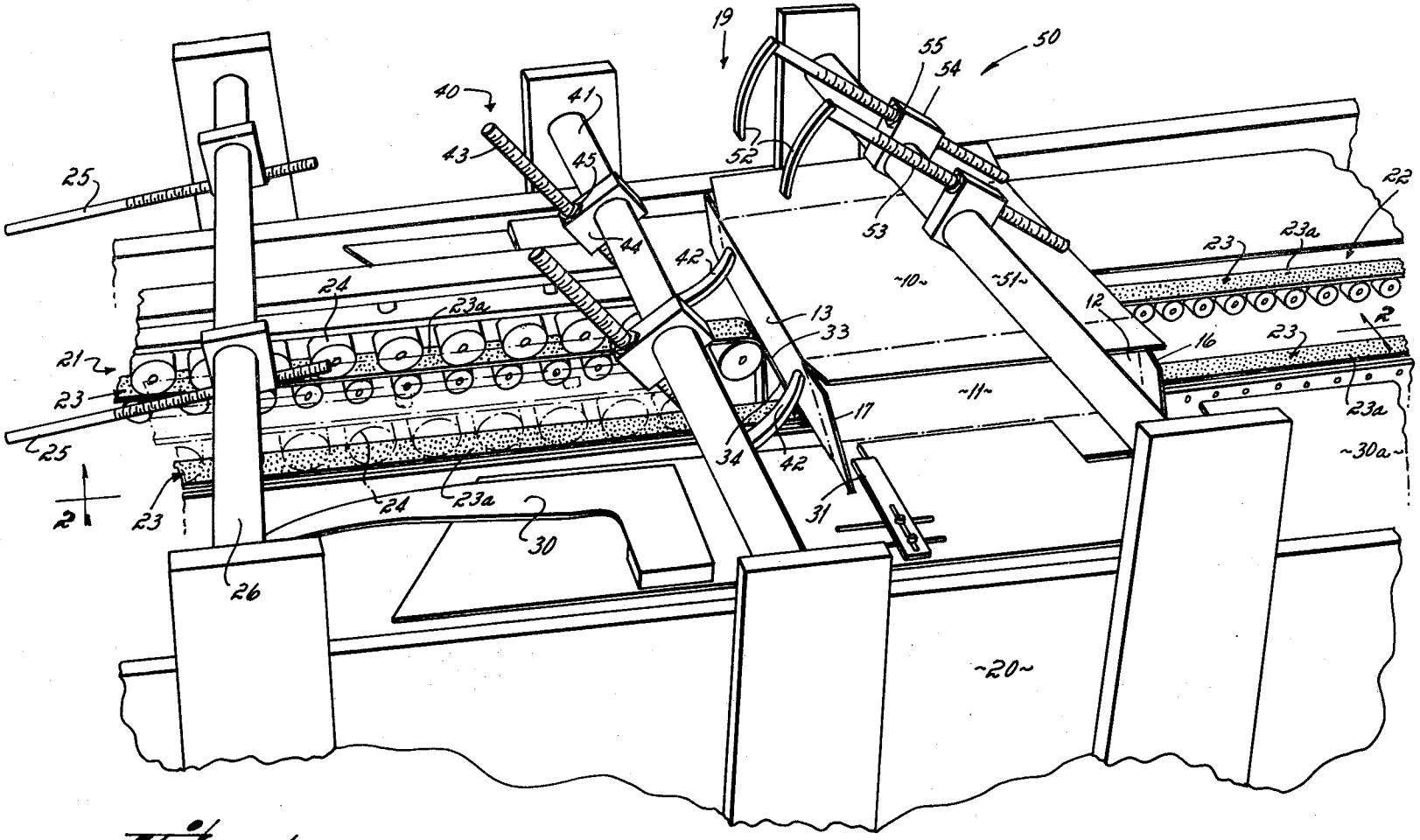
FIG. 1 is a perspective view of the carton erecting apparatus constructed in accordance with the practice of this invention.
Figure 2:
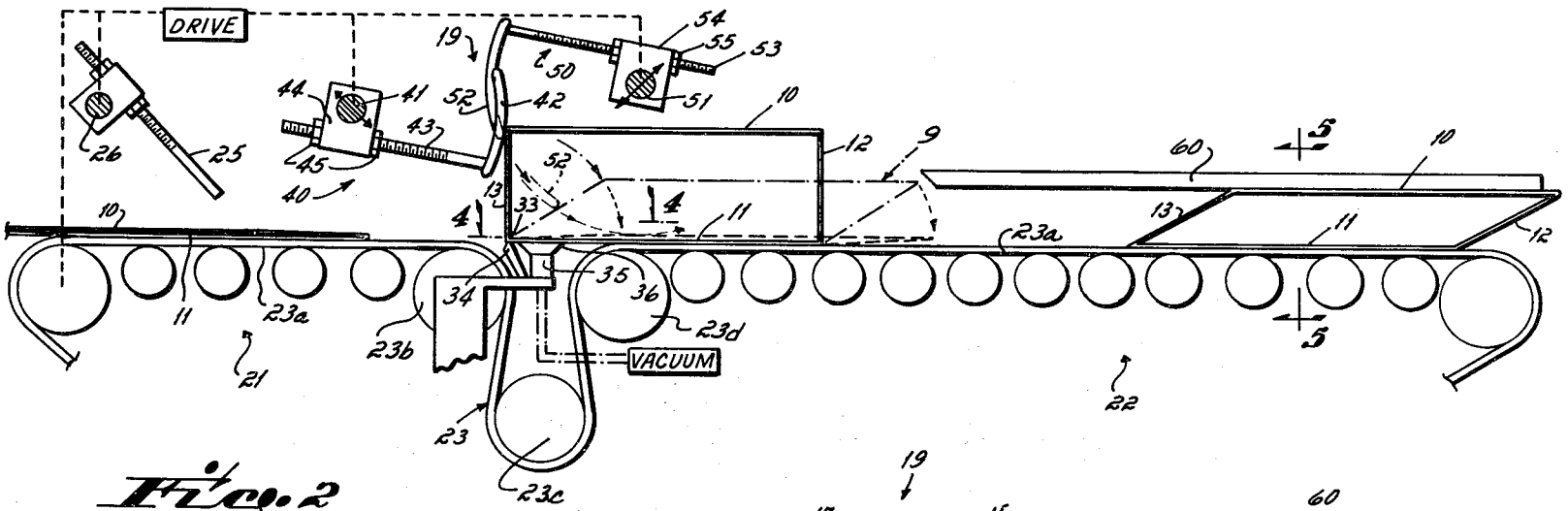
FIG. 2 is a diagrammatic cross-sectional view taken generally along lines 2—2 of FIG. 1.

A flat folded carton blank which is to be erected by the apparatus of the present invention is illustrated in FIG. 1 as an erected carton. It can be seen that the carton 9 has a first surface formed by a top panel 10 and a leading upwardly facing side panel 12; and a second surface formed by a bottom panel 11 and a trailing downwardly facing side panel 13 said panels being joined together on transverse fold lines. A flap 14 is hinged to each end of the top panel, a flap 15 is hinged to each end of the bottom panel, a flap 16 is hinged to each end of the leading panel, and a flap 17 is hinged to each end of the trailing side panel.

The erecting apparatus of the invention includes a frame 20 carrying an upstream conveyor section 21 and a downstream conveyor section 22. Each conveyor section is formed in part by two continuously running, transversely spaced, endless belts 23. The belts have an upper reach **23*a* which is interrupted at the erecting station, indicated generally at 19, by passing around rolls 23*b*, under rolls 23*c* and upwardly around rolls 23*d*** thereby dividing the belts into upstream and downstream sections. The upstream section which carries the blanks in a flat folded condition includes overlying rollers 24 which press the carton blank against at least one of the endless belts 23 to provide the frictional engagement of the blank with the endless belt to move it into the erecting section.

Figure 3:
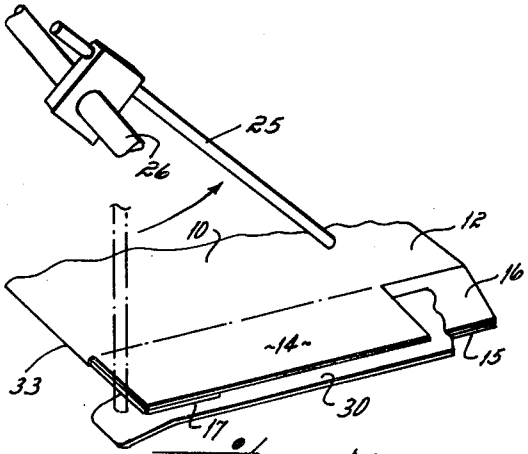
FIG. 3 is a diagrammatic perspective of a portion of the apparatus illustrating a flap engaging finger and a flap plow.

Overlying the upstream section are a pair of flap-engaging fingers 25 mounted on a rotatable shaft 26. The fingers 25 are operable to engage leading flaps 16, forcing them against flaps 15 on the bottom panel, thereby creating a slight spacing between top flaps 14 and bottom flaps 15. Some cartons are constructed with cutouts in flap 16 to permit direct engagement of flap 15 by the fingers 25 since it is necessary only to depress flap 15. A stationary plow 30 on each side of the apparatus passes into that slight spacing, over the flaps 15 and 16 and underneath the flaps 14, as the carton is moved into the erecting section (FIG. 3).

At the erecting section 19 a pair of adjustable stops 31 are mounted on the frame and project upwardly slightly in a position to engage the trailing flaps 17 at each side of the carton, thereby to precisely position the carton in the erecting station. The stops 31 are longitudinally as well as transversely adjustable in order to accommodate different carton sizes and to assure the positioning of the crease 33 between the bottom panel and trailing side panel of a carton precisely on the corner of a breaker bar 34 which is fixedly mounted to the frame and extends transversely across the frame at the erecting section. As obvious to those skilled in the art, stops 31 may alternately be positioned to engage other flaps of the carton construction.

Immediately downstream of the breaker bar 34 and thus located between the breaker bar 34 and belts 23 at rolls 23*d* are a plurality of suction cups 35 (which may also be of a bellows type) which are stationary and which have upwardly flaring lips 36. The cups are spaced apart in a transverse direction and present a single cup width in a longitudinal direction. The lips 36 are very flexible and flex downwardly when they are in engagement with the underlying (second) surface of a carton blank and have suction applied to them. That downward flexing causes the underside of the carton to be drawn downwardly against the supports on either side provided by breaker bar 34 and belts 23 at rolls 23*d* to effect partial opening of the carton, as will be explained in more detail below. A second transverse breaker bar similar to bar 34 may be employed at the downstream side of the suction cups to assist in the partial opening of short (machine direction) carton blanks.

Overlying the upstream conveyor section 21 is a pair of L-shaped opening elements 40 transversely spaced on a rotatable shaft 41. Each opening element 40 has a finger 42 adapted to engage the trailing side panel 13 to swing it upwardly. The finger 42 is mounted on a threaded rod 43 which is secured to a bracket 44 fixed on the shaft 41. A pair of nuts 45 permits the radial extension of the rod 43 and with it the finger 42 to be adjusted with respect to the shaft 41. The brackets 44 are axially positionable with respect to the shaft 41 to accommodate them to varying size cartons.

Overlying the downstream conveyor section 22 is a pair of overbreak elements 50 very similar to the opening elements 40. The overbreak elements are mounted on a rotatable shaft 51, each consisting of a finger 52 mounted on a rod 53 which is adjustably mounted on a bracket 54 fixed to the shaft 51. The rod 53 is threaded and is adjustably secured to the bracket by a pair of nuts 55. The transverse spacing of the overbreak elements 50 is closer than the spacing of the opening elements 40 so that they can pass each other without interference during the operation of the apparatus.

Figure 5:
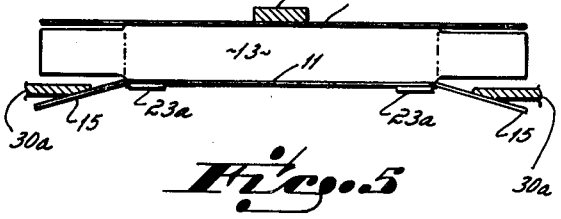
FIG. 5 is a cross-sectional view taken along lines 5—5 of FIG. 2.
Figure 4:
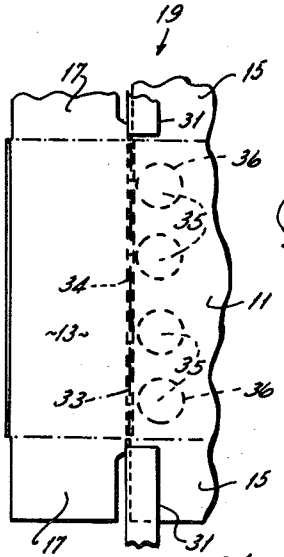
FIG. 4 is a cross-sectional view taken generally along lines 4—4 of FIG. 2.

Overlying the downstream section of the conveyor 22 is a guide rail 60 which is spaced above the upper run 23*a* of the belt 23 by a distance slightly less than the height of the side panels. In this form of the invention, the carton, when overbroken and thrust under the rail 60, will tend to spring up against the rail 60. The "fight" of the carton, that is, its resilience, tends to bias the bottom panel 11 against the upper run 23*a* permitting the carton to be conveyed away from the erecting station and into transport lugs of a conveyor (not shown). Additionally, extensions 30*a* of the plows 30 may overlie the flaps 15 to aid in holding the carton against the upper run 23*a* (FIG. 5).

Alternatively, it may be desired in some cartoning operations to feed a carton, which has been overfolded through 180°, into a nip between the belts 23 and overlying rollers which convey the carton toward the transport lugs in a flat overfolded condition.

Means are, of course, provided for driving the conveyor belts 23, for rotating the shafts 26, 41 and 51, respectively, and for applying a vacuum to the suction cups all in timed relation. These means are shown only diagrammatically for the sake of clarity.

In the operation of the invention, flat folded blanks having an upwardly-facing leading side panel 12 and a downwardly-facing trailing side panel 13 are fed from a magazine (not shown) to the upstream conveyor section 21. In moving toward the erecting station, the flap-engaging fingers 25 briefly engage the leading flaps 16 to press them downwardly, and along with it flaps 15 on the bottom panel 11 below the surface of a stationary plow 30. As the blank moves downstream into the erecting section, the trailing flaps 17 ride above the plow and into engagement with the stops 31. Upon engagement with the stops 31, the blank is momentarily held in the proper position for erecting. In this position the trailing crease 33 between the bottom panel and trailing side panel overlies the upper corner of the breaker bar 34 and the bottom panel is supported on the belts 23 at rolls 23*d*. At this time vacuum is applied to the suction cups 35 which draws the bottom panel or second surface of the blank downwardly with respect to the breaker bar at one end and the conveyor at the other end. The bowing of the second or lower surface slightly shortens the distance between the leading and trailing edges of the carton blank, thereby causing the first or upper surface to bow slightly upwardly. That slight bowing, creating a gap of approximately ¼" between top and bottom panels, is all of the partial opening that is required to provide assurance that the carton will erect properly when it is engaged by the opening element.

As soon as suction is applied, the rotatable opening element 40 swings up under the trailing side panel 13 to swing it to a substantially vertical position through an angle of approximately 90°. As the trailing side panel 13 is held momentarily in the vertical attitude, the overbreak element 50 rotates into engagement with the trailing side panel, forcing it in a downstream direction through another 90° thereby overbreaking the carton blank through a total of 180°. By modifying the shape or position of opening element 40, the trailing flap may be swung through substantially less than or greater than 90°, all of which would depend on a specific carton design.

When the trailing side panel is swung upwardly, the upward movement of the panel will carry with it its hinged flaps above stops 31. Upon removal of the vacuum at this time, the endless belts 23 are able to continue the movement of the carton blank in a downstream direction.

As the carton blank moves downstream, it slides under guide rail 60 and is then released by passing beyond the overbreak element 50. When released, the carton blank will flex upwardly and its "fight" will bias the top panel 10 against the guide rail 60. This biasing arising out of the resilience of the board from which the blank is formed forces the bottom panel against the belts 23 so that the belts 23 can continue to move the now opened carton blanks in a downstream direction.

Immediately adjacent the downstream end of the belts 23 the carton blanks will be discharged between the leading and trailing transport lugs of a known cartoner, which is not shown.

In the embodiment of FIGS. 1–5 a mechanism for opening the carton blank has been shown as consisting of a plurality of suction cups 35 and supports on either side of the suction cup consisting of breaker bar 34 and belts 23 passing over rolls **23*d*. That concept for partially opening carton blanks to avoid the problem of elbowing is useful in other environments. A sample of one such environment is illustrated in FIG. 6**.

Figure 6:
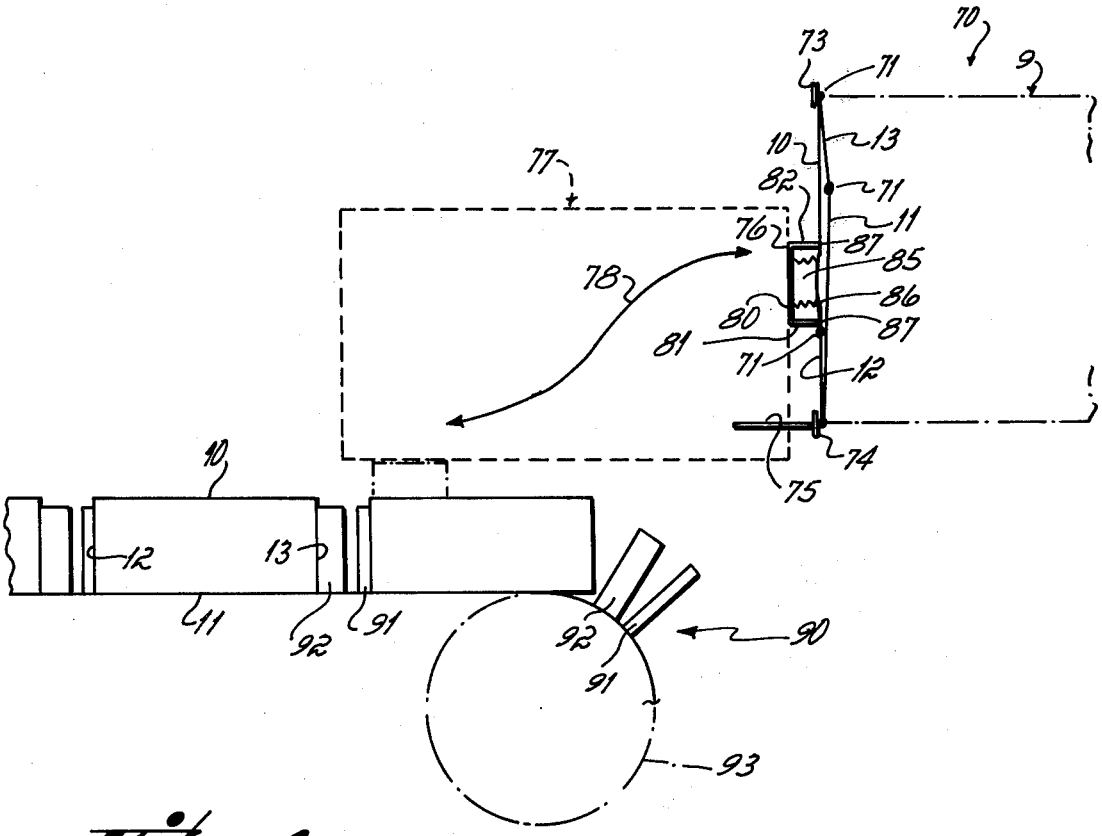
FIG. 6 is a diagrammatic view of an alternative embodiment.

As shown in FIG. 6, the carton blanks 9 are loaded in a flat folded condition in a magazine 70, the blanks being vertically oriented. As before, each blank has a top panel 10 and a bottom panel 11, a lead side panel 12 and trailing side panel 13 all interconnected by creases 71. The designation top and bottom panels and the like are used even though the blanks are vertically oriented. These terms are used to describe the carton as it is ultimately opened and carried in the transport lugs of a transport conveyor. The bottom panel 11 and trailing side panel 13 form a first surface and the top panel 10 and leading side panel 12 form a second surface when the blank is flat. At the forward end of the magazine 70, the upper edges of the blanks are restrained by the bar 73 and the lower edges are restrained by a bar 74, each bar overlying a fraction of an inch of the extremity or edge of each blank. A horizontal breaker plate 75 projects forwardly from the bar 74 to assist in the erecting of the carton as will be described. A channel shaped carrier 76 is supported on a kinematic linkage shown diagrammatically at 77 to swing the carrier 76 generally in the path illustrated by the line 78.

The carrier 76 has a wall 80 which supports two side bars 81 and 82 to provide the channel configuration. A bellows shaped vacuum cup 85 is mounted on the wall 80 of the carrier 76. One cup 85 is illustrated but a plurality may be employed depending on the length of the blank to be opened.

The bellows vacuum cup has outer lips 86 which are normally positioned at approximately the plane defined by the edges 87 of the side walls 81, 82 of carrier 76. When vacuum is applied to the cup, the flexible bellows retracts into the carrier with the lips 86 of the cup 85 pulling the wall of the blank which they engage slightly into the space between the walls 81, 82. The action imparts a slight bow to the second surface of the blank which faces the carrier and effects a partial opening of the carton blank. Even if there is a slight tendency of the blank to elbow when the vacuum cup is applied, the bow imparted to the wall of the blank prevents the elbowed relationship from remaining in the unerected blanks so the further forces on the blank particularly including the forces on the side panels will cause the blank to erect properly.

Disposed below the magazine is the transport conveyor 90 which carries leading transport lugs 91 and trailing transport lugs 92. The transport conveyor is shown passing around sprocket 93 at the upstream end of the transport conveyor and the leading and trailing transport lugs are spaced by the width of the carton in a known manner.

The kinematic linkage 77 of the carrier 76 and the transport conveyor are driven together and thus timed to effect the opening of a carton blank and placement of the carton blank between the transport lugs as the leading and trailing transport lugs are in a diverging orientation arising out of the passage around the arc of the sprocket 93.

As the carrier begins its excursion from the magazine to the transport conveyor, the blank, and particularly the leading side panel 12, is caused to brush past the horizontal bar 75 thereby camming the blank to an open or erected attitude.

If it were not for the initial bowing of the blank by drawing on the wall toward the support edges 87 of the carrier 80, by means of the vacuum cup 85 there would be a tendency of the blank to elbow as it is brushed past the bar 75, however the introduction of the bowing eliminates this tendency.

In the embodiment of FIG. 6 as well as in the embodiment of FIGS. 1–5, the partial opening of the carrier blanks through the bowing concept has been shown in two different structures. It should be understood the variations from this are included within the scope of the present invention. The principal elements involved in the present invention include two support members located well inboard of the edges of the blank and a vacuum cup between the supporting members which grips a wall of the flat folded carton blank and draws it toward the supports to effect the bowing. For most applications there appears to be no criticality in the configuration of the supporting element or in the location of them and the vacuum cup with respect to the support of the blank. For example, the two supporting elements might engage a blank on one panel only or the two supporting elements might respectively engage two panels with the crease joining the two panels located between the supporting elements. The supporting elements should, however, be fairly closely spaced from each other, the distance between them being for example, less than one-half the width of the blank which they engage and they should be located well inboard of the parallel edges of the blank.

I claim:

1. In apparatus for erecting tubular carton blanks which are flat folded and have a first surface on one side and a second surface on the other side, a mechanism for partially opening said flat folded blank comprising, at least one suction cup, a support on each side of said suction cup, means for positioning said cup and supports against the second surface of a flat folded carton blank with said supports in engagement with said surface of said blank inboard of the edges of said blank, said supports having carton engaging surfaces lying in a plane, said cup having a lip normally located approximately in said plane and engageable with a carton blank surface and movable away from the plane of said supports upon application of vacuum to said cup to pull said second surface past the plane of said supports and thereby bow the surface of the blank engaged by said cup to partially open said blank, and means for applying vacuum to said cup.

2. A mechanism as in claim 1 in which one of said supports is a breaker bar.

3. A mechanism as in claim 1 in which said supports are formed by a channel shaped carrier having two spaced walls, said suction cup being mounted between said two spaced walls.

4. A mechanism as in claim 1 in which said suction cup is bellows shaped terminating in a lip lying approximately in the plane defined by said support, said cup, upon application of vacuum, grasping said second surface and collapsing within said supports to pull said second surface past said supports to bow said second surface.

5. In apparatus for erecting tubular carton blanks which are flat folded and have a first surface on one side and a second surface on the other side, a mechanism for partially opening said flat folded blank comprising, at least one suction cup, a support on each side of said suction cup, means for positioning said cup and supports against the second surface of a flat folded carton blank with said supports in engagement with said surface of said blank inboard of the edges of said blank, said supports having carton engaging surfaces lying in a plane, said cup having a lip normally located approximately in said plane and engageable with a carton blank surface and movable away from the plane of said supports upon application of vacuum to said cup to pull said second surface past the plane of said supports and thereby bow the surface of the blank engaged by said cup to partially open said blank, and means for applying vacuum to said cup, said suction cup and supports remaining in a substantially fixed relationship to each other.

6. Apparatus for erecting tubular carton blanks which are flat folded and have a first flat surface on one side and a second surface on the other side, the apparatus comprising, a magazine for supporting a plurality of said carton blanks, a channel-shaped carrier having two spaced walls and a suction cup mounted in said carrier between said two spaced walls, means for moving said carrier adjacent said magazine to a position against the second surface of a flat folded carton blank with said carrier walls in engagement with said surface of said blank inboard of the edges of said blank, said carrier walls having edges lying in a plane, said cup having a lip normally located approximately in said plane and engageable with a carton blank and movable away from the plane of said wall edges upon application of vacuum to said cup to pull said second surface past the plane of said wall edges and thereby bow the surface of said blank engaged by said cup to partially open said blank, and means for applying vacuum to said cup.

7. Apparatus according to claim 6 further comprising, means for moving said carrier past breaker means to complete the erecting of the carton and to place said carton between transport lugs of a transport conveyor.

8. In apparatus for erecting tubular carton blanks which are flat folded on transverse fold lines and have a first surface on one side and a second surface on the other side, a mechanism for partially opening said flat folded blank comprising, a pair of longitudinally spaced supports, at least one suction cup located in substantially fixed relation to said supports and presenting a single cup width in a longitudinal direction, means for positioning said cup and supports against the second surface of a flat folded carton blank with said supports in engagement with said surface of said blank inboard of the edges of said blank, said supports having carton engaging surfaces lying in a plane, said cup having a lip normally located approximately in said plane and engageable with a carton blank surface and movable away from the plane of said supports upon application of vacuum to said cup to pull said second surface past the plane of said supports and thereby bow the surface of the blank engaged by said cup to partially open said blank, and means for applying vacuum to said cup.

* * * * *